US010393148B2

(12) United States Patent
Bergamini et al.

(10) Patent No.: US 10,393,148 B2
(45) Date of Patent: Aug. 27, 2019

(54) BARREL TURBO-MACHINE COMPRISING RETRACTING SHEAR

(71) Applicant: Nuovo Pignone Srl, Florence (IT)

(72) Inventors: Lorenzo Bergamini, Bari (IT); Donato Antonio Ripa, Bari (IT); Fabrizio Milone, Bari (IT)

(73) Assignee: Nuovo Pignone Srl, Florence (IT)

( * ) Notice: Subject to any disclaimer, the term of this patent is extended or adjusted under 35 U.S.C. 154(b) by 483 days.

(21) Appl. No.: 15/031,983

(22) PCT Filed: Oct. 24, 2014

(86) PCT No.: PCT/EP2014/072834

§ 371 (c)(1),
(2) Date: Apr. 25, 2016

(87) PCT Pub. No.: WO2015/059266

PCT Pub. Date: Apr. 30, 2015

(65) Prior Publication Data

US 2016/0265555 A1 Sep. 15, 2016

(30) Foreign Application Priority Data

Oct. 25, 2013 (IT) ..... CO2013A0053

(51) Int. Cl.
*F04D 1/06* (2006.01)
*F04D 29/62* (2006.01)
(Continued)

(52) U.S. Cl.
CPC ..... *F04D 29/624* (2013.01); *F04D 1/06* (2013.01); *F04D 17/12* (2013.01); *F04D 17/122* (2013.01);
(Continued)

(58) Field of Classification Search
None
See application file for complete search history.

(56) References Cited

U.S. PATENT DOCUMENTS 2,196,895 A * 4/1940 Bowman ..... F16J 13/10 220/233
3,695,482 A * 10/1972 Smith ..... B01J 3/03 220/328

(Continued)

FOREIGN PATENT DOCUMENTS

JP 53104411 A 9/1978

OTHER PUBLICATIONS

Italian Search Report issued for IT application CO2013A000053 dated Jul. 22, 2014.

(Continued)

*Primary Examiner* — Jason D Shanske
*Assistant Examiner* — Theodore C Ribadeneyra
(74) *Attorney, Agent, or Firm* — Baker Hughes Patent Organization

(57) ABSTRACT

A turbo machine comprising a barrel casing having a cylindrical internal surface defining an internal containment volume, a bundle having a cylindrical shape, adapted to be accommodated into the internal containment volume, a cylindrical cover connected to the bundle to close the internal containment volume and hold the bundle inside the barrel casing, a split shear ring adapted to fix the barrel casing with the cylindrical cover wherein the external cylindrical surface of the cylindrical cover and the cylindrical internal surface of the barrel casing are provided with a first circumferential groove and a second circumferential groove adapted to accommodate the shear ring and wherein the first grooves is adapted to completely accommodate the cross section of the split shear ring.

12 Claims, 6 Drawing Sheets

(51) Int. Cl.

| | |
|---|---|
| ***F04D 29/42*** | (2006.01) |
| ***F04D 29/52*** | (2006.01) |
| ***F04D 29/64*** | (2006.01) |
| ***F04D 17/12*** | (2006.01) |

(52) U.S. Cl.

CPC ..... *F04D 29/4206* (2013.01); *F04D 29/426* (2013.01); *F04D 29/522* (2013.01); *F04D 29/528* (2013.01); *F04D 29/628* (2013.01); *F04D 29/644* (2013.01); *F04D 29/648* (2013.01); *F05D 2260/36* (2013.01)

(56) References Cited

U.S. PATENT DOCUMENTS 3,766,947 A * 10/1973 Osburn ..... F16L 55/11 138/89
3,874,814 A 4/1975 Carroll et al.
4,218,181 A * 8/1980 Komatsu ..... F04D 29/624 29/446
4,380,405 A * 4/1983 Kaneki ..... F04D 29/4206 403/318
4,489,850 A * 12/1984 Reneau ..... F16J 13/08 220/315
5,127,535 A 7/1992 Shinno
6,336,641 B1 * 1/2002 Williams ..... B63G 8/30 277/637
7,802,694 B2 * 9/2010 Lee ..... B01J 3/03 220/319
7,850,427 B2 12/2010 Peer et al.
8,631,961 B2 * 1/2014 Naruse ..... F04D 17/125 220/327
2008/0031732 A1 * 2/2008 Peer ..... F04D 1/06 415/201

OTHER PUBLICATIONS

Search Report and Written Opinion issued in connection with corresponding PCT application PCT/EP2014/072834, dated Jan. 1, 2016.
Examination Report issued in connection with corresponding GC Application No. 2014/28160 dated Sep. 18, 2018.

* cited by examiner

BARREL TURBO-MACHINE COMPRISING RETRACTING SHEAR

BACKGROUND

Embodiments of the subject matter disclosed herein relate to turbo-machines, methods for fixing bundles of a turbo-machines, and covers for the openings of barrel casings.

A centrifugal compressor or pump comprise an external pressure barrel casing that accommodates a diaphragm bundle. Typically, the barrel casing defines a cylindrical cavity and the diaphragm bundle has a cylindrical shape. The diaphragm bundle typically comprises at least rotor and stator with their impellers, seals and fluid channels.

The cylindrical cavity, defined by the barrel casing, has an open at one side, typically the circular lateral side. This open allow the insertion of the bundle. The open is closed after insertion of the bundle by mean of a cover, which typically has the form of an end wall structure.

The barrel casing contains stationary and rotatable components. Stationary components are in general rigidly fastened to the barrel casing; whilst rotatable components are generally held up by bearings positioned in the cover.

The barrel casing of a turbo-machine in operation tends to expand radially, due to the rise of temperature and pressure at its inside; whilst the cover tends to shift axially. This can bring to a misalignment of stationary components with respect to rotatable components, affecting the working conditions of the machine. In fact, it is essential that the center axis of the cover is kept at all times in alignment with the central axis of the barrel casing.

FIG. 1 shows a solution known from the prior art, where barrel casing 10 is firmly fixed to the cover 20 (after insertion of the bundle 5) by mean of shear ring 30. The shear ring 30 is a ring composed by two, or four (or even more) symmetrical portion, that when joined together in contiguous way form the whole ring. The inner surface of the barrel casing 10 (namely on the surface facing the volume containing the bundle 5) is provided with a circumferential groove 70 adapted to receive the portions composing the shear ring 30. The outer surface 20*a* of the cover 20 is provided with a similar circumferential groove 40, which is adapted to receive partially the shear ring, when the turbo-machine is assembled. The outer surface of the barrel casing 10 is provided with a plurality of screws 80 (typically one screw per portion composing the shear ring), to move (partially) the shear ring from the groove 70—on the barrel casing 10—to the groove 40—on the cover 20. It worth noting that the groove 40 on the cover 20 has a depth adapted to receive only part of the cross section of the shear ring 30.

Thus the steps for assembling a turbo-machine of this kind are: insert the various portion of the shear ring on the groove 70; insert the bundle 5; mount the casing 20 on the open side of the barrel casing 10; fix the barrel casing 10 to the cover 20 by mean of the shear ring 30, threading the screws emerging from the outer surface of the barrel casing 10. The shear ring 30 is thus partially engaged in the groove 40 and partially engaged in the groove 70, blocking, in this way, the axial movement of the bundle 5 and the cover 20.

In this configuration, the depth of the groove 70 has to be dimensioned to contain completely the cross section of the shear ring 3, in order to perform the insertion of the bundle 5 and the successive fixing. Furthermore, un-engaging screws must be provided (not shown in FIG. 1) to raise up the shear ring 30 on the groove 70 on the barrel casing 10, for dismounting the bundle 5 to perform the maintenance operations.

Thus, the wall of the barrel casing 10 must have a certain minimum thickness to realize the groove 70 of the proper dimension. This solution increases the overall dimension of the turbo machine, the amount of material required to produce the barrel casing 10 and impacts with dimensional constraints of the turbo-machine.

Therefore there is a need for a system for fixing a cover in a turbo machine barrel casing that is easier to mount and dismount, thus allowing saving on maintenance, and does not require an increase in size at the mouth of the barrel casing.

SUMMARY OF THE INVENTION

According to first exemplary embodiments, there is a turbo machine comprising: a barrel casing having a cylindrical internal surface defining an internal containment volume, a bundle having a cylindrical shape, adapted to be accommodated into the internal containment volume, a cylindrical cover connected to the bundle to close the internal containment volume and hold the bundle inside the barrel casing, a split shear ring adapted to fix the barrel casing with the cylindrical cover wherein the external cylindrical surface of the cylindrical cover and the cylindrical internal surface of the barrel casing are provided with a first circumferential groove and a second circumferential groove adapted to accommodate the shear ring and wherein the first grooves is adapted to completely accommodate the cross section of the split shear ring.

According to second exemplary embodiments, there is a method for fixing a bundle of a turbo machine inside a barrel casing.

Specifically, before the insertion of the bundle into the barrel casing, a split shear ring is completely inserted within a first groove machined in the external surface of a cover for an opening of a barrel casing of a turbo machine.

More in general, before insertion of the bundle into the barrel casing, one or more shear action devices are completely inserted within one or more recesses of the bundle; furthermore, after insertion of the bundle into the barrel casing, the one or more shear action devices are partially inserted within the one or more recesses of the bundle and partially inserted within one or more recesses of the barrel casing; the implicit movement of these devices is at least partially in the radial direction; such general principle is applicable for example to covers for openings of a barrel casing of a turbo machine. In an embodiment, the one or more shear action devices are held within the one or more recesses of the bundle by one or more springs. More particularly, the one or more shear action devices are pulled out of the one or more recesses of the bundle by one or more mechanical devices acting on the one or more shear action devices; the movement of these devices is at least partially in the radial direction.

According to third exemplary embodiments, there is system for holding a cover connected to a bundle in a barrel casing of a turbo machine by means of a shear ring that engage partly the first groove and partly the second groove, the first groove machined in the external cylindrical surface of the cover and the second groove machined in the inner surface of the barrel casing wherein the first groove is adapted to accommodate completely the cross section of the shear ring and wherein the shear ring is maneuverable from outside the barrel casing, by mean of screwing means.

BRIEF DESCRIPTION OF THE DRAWINGS

The present invention will become more apparent from the following description of exemplary embodiments to be considered in conjunction with accompanying drawings wherein.

DETAILED DESCRIPTION

The following description of exemplary embodiments refer to the accompanying drawings. The same reference numbers in different drawings identify the same or similar elements. The following detailed description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
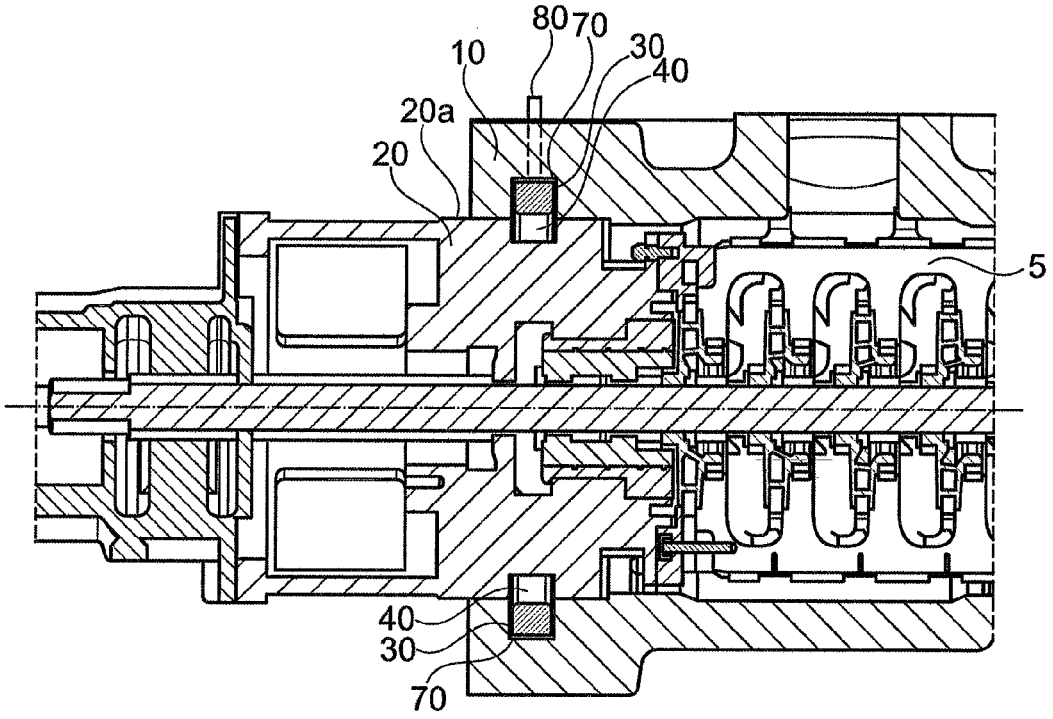
Fig. 1 (Prior Art)
FIG. 1 shows a section view of a turbo-machine with the barrel casing and the cover fixed according the state of the art.
Figure 2:
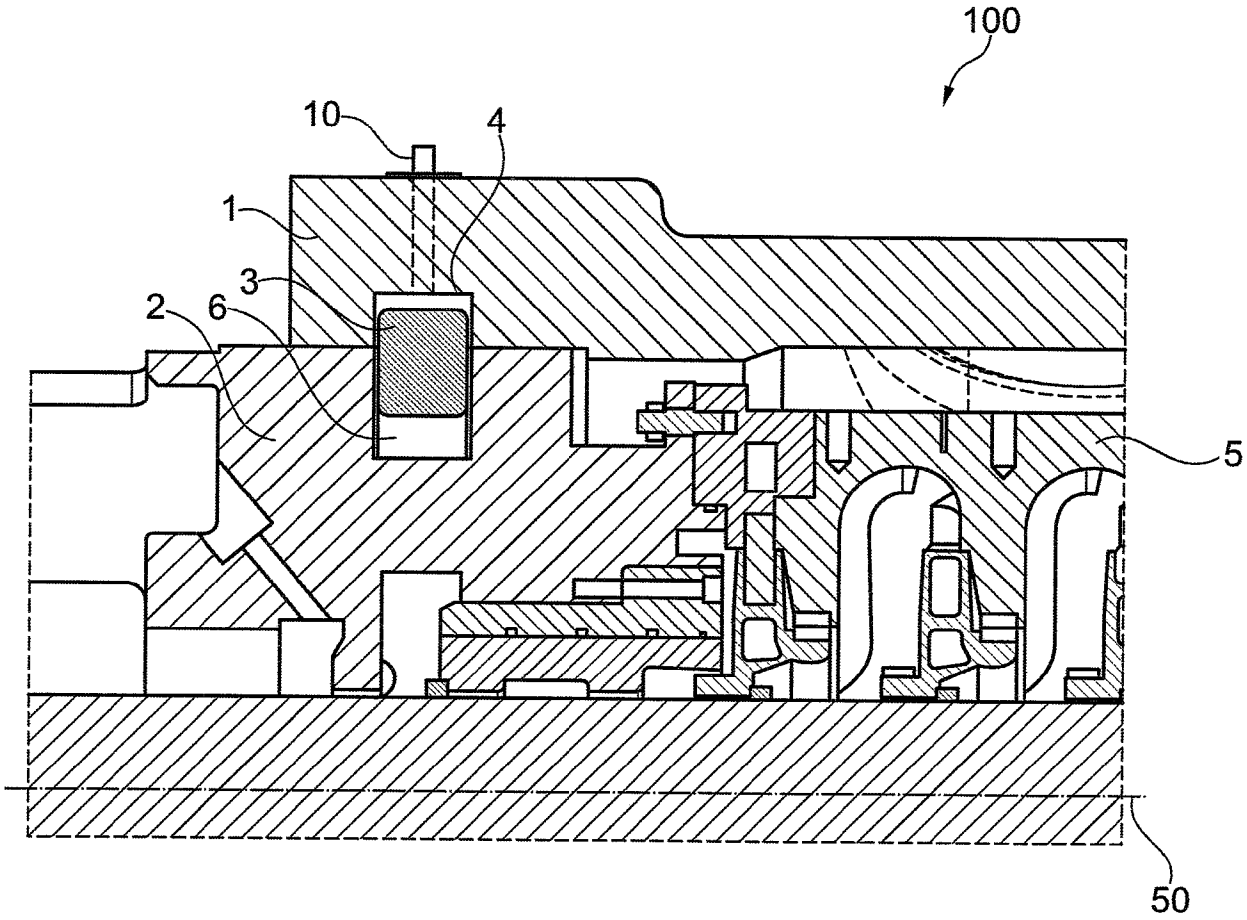
FIG. 2 shows a partial section view of a turbo-machine with the barrel casing and the cover fixed according to an exemplary embodiment.

FIG. 2 shows a cross section of a part of a turbo-machine 100. The turbo-machine 100 comprises a barrel casing 1 having a cylindrical internal surface defining an internal containment volume. In the internal cavity is accommodated a bundle 5 having a cylindrical external surface. The bundle 5 is inserted into the barrel casing 1 in the axial direction (according to the axis 50 of the turbo-machine) through a lateral opening on the barrel casing 1. Furthermore, the turbo-machine 100 comprises a cylindrical cover 2 connected to the bundle 5 that closes the opening on the barrel and holds the bundle 5 inside the barrel casing 1. Thus, in a mounted configuration of the turbo-machine 100 the containment volume of the bundle 5 is a volume closed by mean of the barrel casing 1 and the cover 2.

The fixing between the barrel casing 1 and the cover 2 occurs by mean of a shear ring 3. For this scope, a first groove 6 is provided on the outer surface of the cover 2, to accommodate the cross section of the shear ring 3. In particular, the first groove 6 is adapted to accommodate the whole cross section of the shear ring 3. A second groove 4 is provided on inner surface of the barrel casing 1 to accommodate the cross section of the shear ring 3. In particular, the second groove 4 is adapted to accommodate a part of the whole cross section of the shear ring 3.

The shear ring 3 is adapted to fix barrel casing 1 and the cover 2 and consequently avoid axial movement of the bundle 5. Thus, the ring 3 is subject to shear forces; for this scope the cross section of the shear ring 3 has a rectangular shape; the grooves 6 and 4 have the same (complementary) shape.

FIG. 2 shows a mounted configuration of the turbo-machine 100. In the configuration, the barrel casing 1 and the cover 2 are in contact and the shear ring 3 is partially accommodated on the first groove 6 and partially accommodated on the second groove 4. In this way, axial movements, with respect to the axis 50, of the cover 2 and the bundle 5 are avoided. The first groove 6 is a circumferential groove on the cover 2. The second groove 4 is a is a circumferential groove on the barrel casing 1. The shear 3 is composed of two (or more) portions. These portions, when reciprocally fixed in contiguous way, form the whole shear ring 3. For example, if a shear ring 3 is formed by two equal portions, a first one and a second one; the first portion will engage the first half of the two circumferential grooves 4 and 6; the second portion will engage the second half of the two circumferential grooves 4 and 6. In the description, the term "shear ring 3" thus comprise the various portions that form the shear ring 3. The shear ring 3 is associated to a screw 10 to move the ring 3 from and to the axis 50, in order to realize the mounting and dismounting phases. This aspect will be clearer afterwards, in particular with reference to FIGS. 3, 4 and 5.

Figure 3:
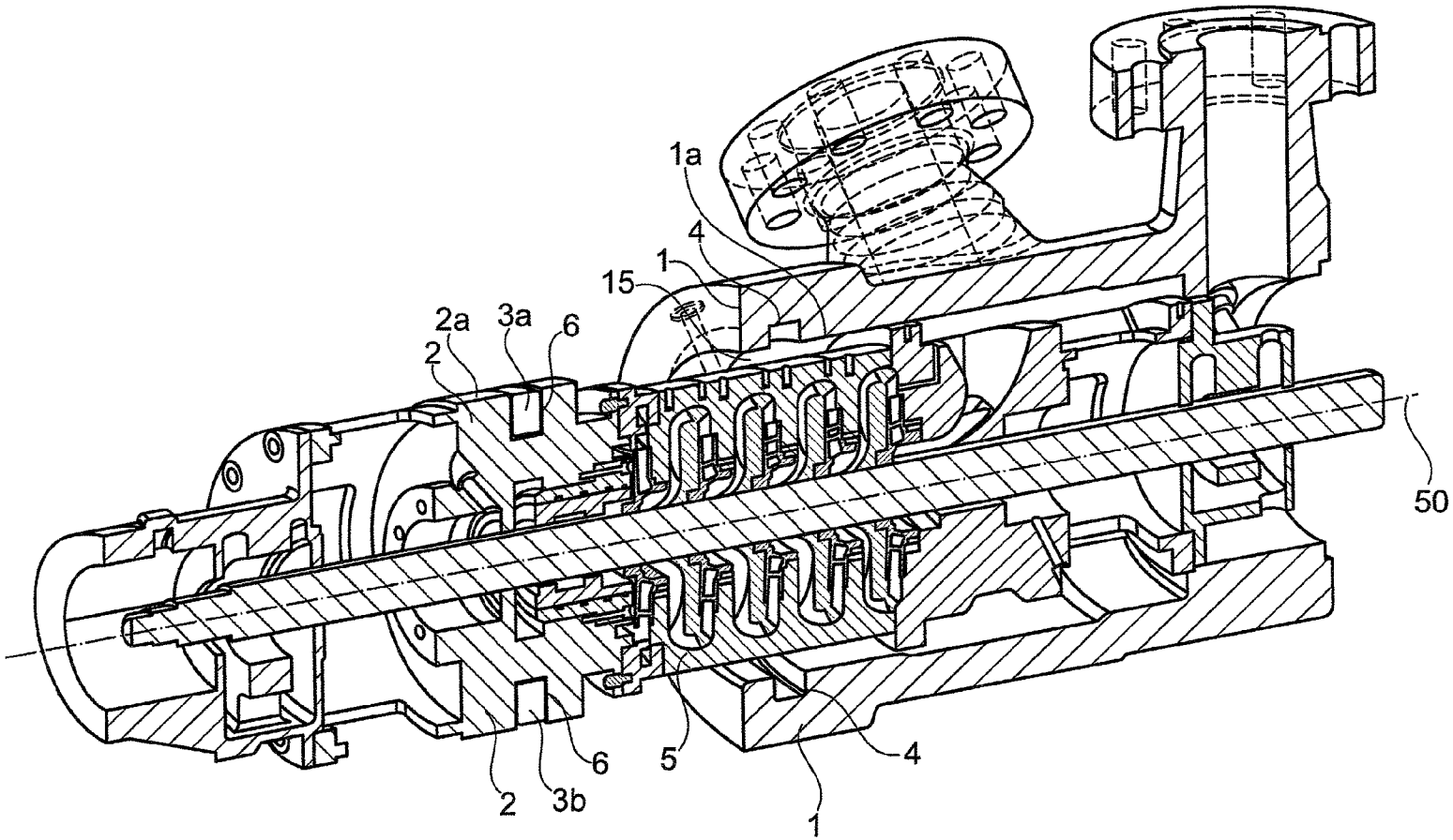
FIG. 3 shows a tridimensional view of a turbo-machine according to an exemplary embodiment in a first mounting condition.

FIG. 3 shows a turbo-machine during a mounting phase. In the phase the bundle 5 is inserted in the barrel casing 1 through the opening 15 of the barrel casing 1 itself. In one embodiment, the shear ring 3 comprise two portion. A first portion 3*a* engages the part of the groove 6 at higher portion of the cover 2, a second portion 3*b* engages the part of the groove 6 at the lower portion of the cover 2. In one embodiment are provided holding means to maintain the shear ring 3 completed engaged on the groove 6 during mounting phase.

The shear ring 3 is movable in a first mounting position (shown in FIG. 3), in which the ring completely engages in the groove 6, namely the cross section of the ring 3 is wholly contained in the groove 6; and in a second mounted position (shown in FIG. 5) in which the ring partially engages the groove 6 and partially engages the groove 4, namely the cross section of the ring 3 is partially contained in the groove 6 and partially contained in the groove 4; and a third demounting position coinciding with the first mounting position.

The clearance between the bundle 5 and barrel casing 1 is very limited and designed in relation with the thermodynamic cycle of the turbo-machine. The outer surface 2*a* of the cover 2 and the inner surface 1*a* of the barrel casing 1 are in contact in mounted configuration. Thus to insert the bundle 5 and close the open 15 no part can protrude from the outer surface 2*a* of the cover 2. In fact, during the mounting phase, the shear ring 3 is completely engaged in the groove 6. The portions 3*a* and 3*b* could slip off from their position in the groove 6 during the mounting phase. In particular second portion 3*b*, at the lower portion of the cover 2, due to gravity force could very easily slip off. To the end, the shear ring is provided with holding means (not show in figure, but visible in FIG. 6) adapted to maintain the ring 3 in the mounting position during the mounting phase.

Figure 4:
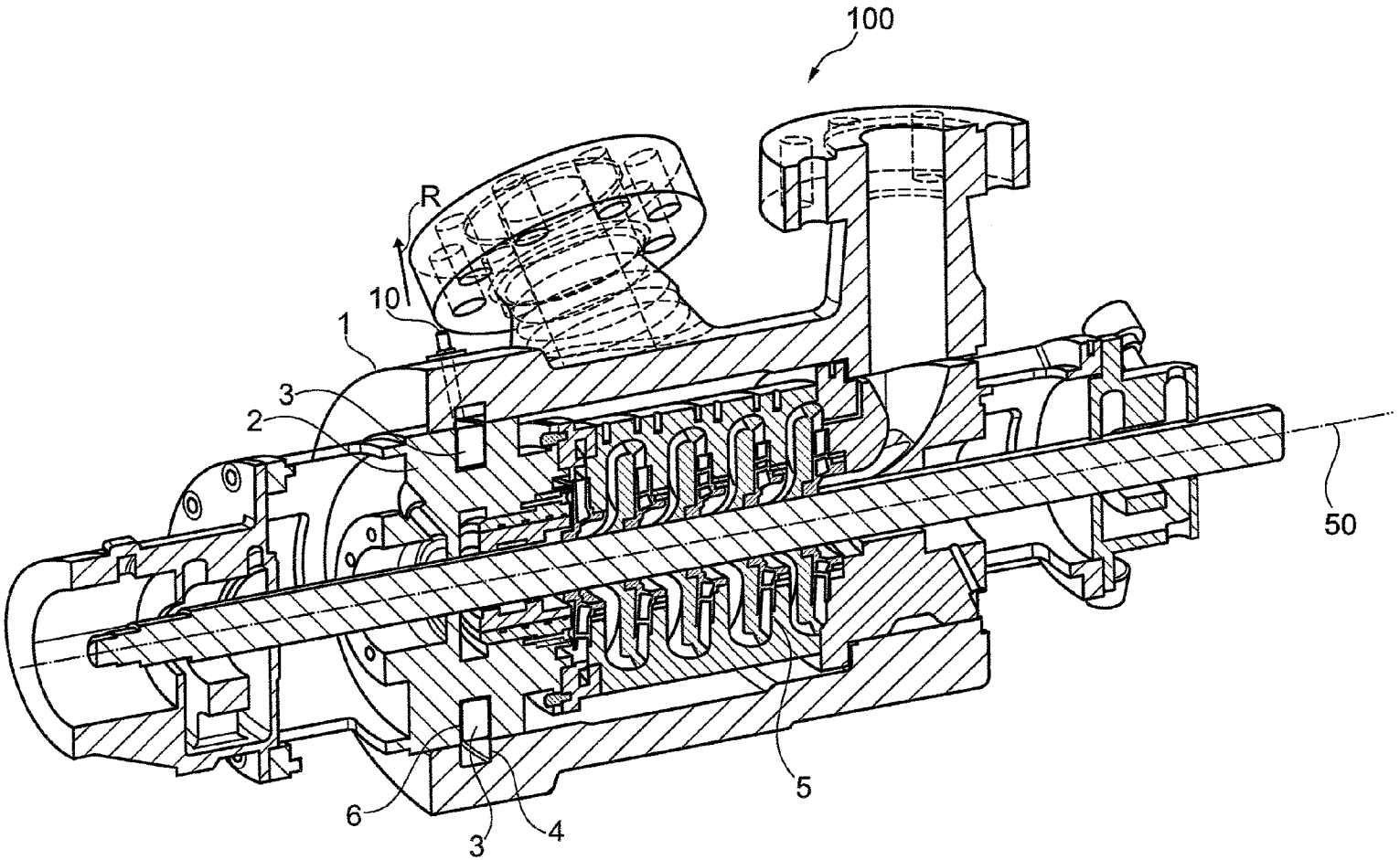
FIG. 4 shows a tridimensional view of the turbo-machine of FIG. 3 in a second successive mounting condition.

FIG. 4 shows the shear ring 3 in a still first mounting position, but with the bundle 5 inserted in the barrel casing 1 and the open of the same closed by the cover 2.

In this position, the operator can move the shear ring 3 in the second mounted position and thus realize the fixing of the barrel casing 1 with the cover 2. The screw 10 allows the movement of the shear ring 3 from the first to the second position. In one embodiment, barrel casing 1 comprises a first through hole from the surface of the outer surface of the barrel casing 1 to the seat defined by the groove 4. In this way, the screw 10 can enter in contact with the ring 3. In particular, the threaded portion of the screw 10 engage with a threaded hole on the ring 3. The screwing action imposed raise the ring 3 outwardly with respect to the axis 50, according to the radial direction R. Thus the ring 3 engages the groove 4. In one embodiment, the thread on the ring 3 and the screw 10 are configured to raise the ring 3 so as that in the mounted configuration it fully engages the groove 6. In another embodiment, the thread on the ring 3 and the screw 10 are configured to raise the ring 3 so that in the mounted configuration it partially engages the groove 6.

In one embodiment, one screw 10 per portion of ring 3 is provided. Furthermore, are provided reference means adapted to put the ring 3 in one predetermined angular position. In the predetermined angular position, the first through hole on the barrel casing 1 collimate with the threaded hole on the ring 3. The operator can thus performs the mounting procedure.

Figure 5:
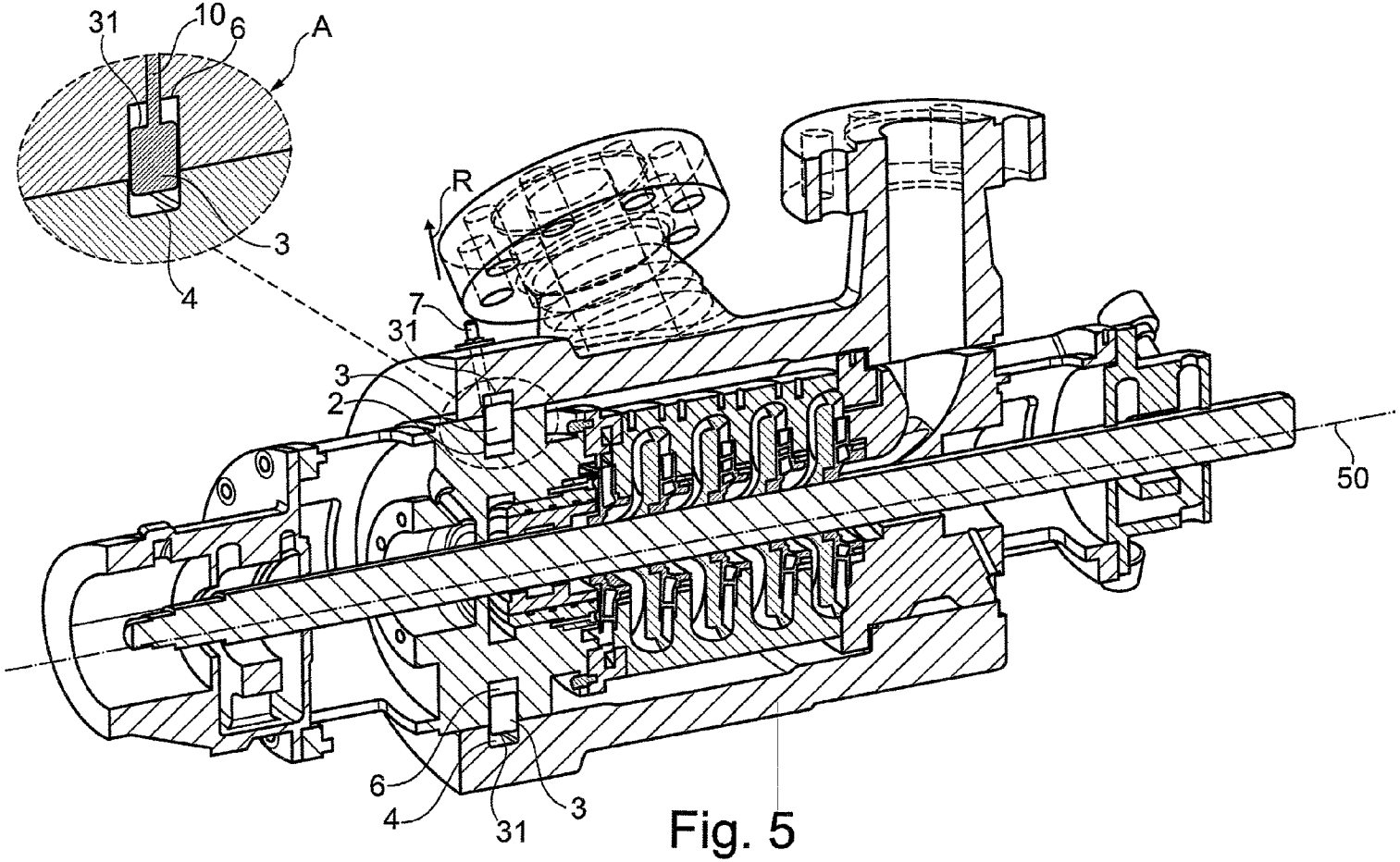
FIG. 5 shows a tridimensional view of the turbo-machine of FIGS. 3 and 4 in a final mounted condition.

FIG. 5 show a turbo-machine with a ring 3, according to an embodiment, in a mounted position. As shown in the enlarged view A, the ring 3 fully engages the first groove 6 and partially engages the second groove 4. In this way, the fixing between the cover 2 and the barrel casing 1 is realized. As the, the ring 3 is raised up to engage the groove 6 toward radial direction R. This movement is performed by mean of the screw 10.

In one embodiment, the same screw 10 is adapted to move the ring 3 to the third demounting position, coinciding with the first mounting position, namely the groove cross section of the ring 3 wholly contained in the first groove 6.

According to this embodiment, a first screwing sense of the screw 10, i.e. the clockwise sense, realize the raising of the ring 3 from the first mounting position to the second mounted position. A second screwing sense of the screw 10, i.e. the counterclockwise sense, realize the lowering of the ring 3 from the second mounted position to the third demounting position (coinciding with the first mounting position).

Figure 6:
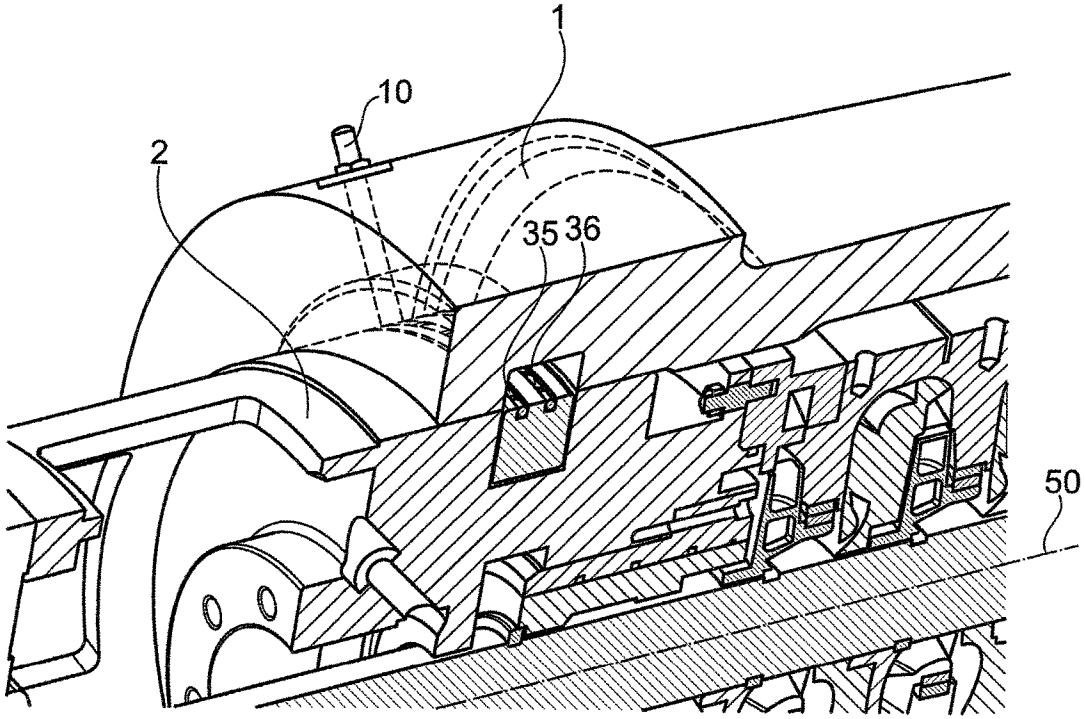
FIG. 6 shows a partial and enlarged tridimensional view, with focus on the zone in which the fixing between the barrel casing and cover occurs.

As shown in FIG. 6, in one embodiment, shear ring 3 is provided with holding means (not shown in FIG. 5, but visible in FIG. 6). The means maintain the shear ring 3 completed engaged on the groove 6 in the mounting position. In one embodiment, these means comprise resilient means. The resilient means have an annular configuration and are realized on the outer surface 31 of the ring 3. The outer surface 31 of ring 3 is the surface that face the groove 4.

In one embodiment the resilient means comprise an annular spring that surround the ring 3. According to another embodiment, the resilient means comprise a first helical spring 35 on a first groove realized on the surface 31 of the ring 3, and a second helical spring 36 on a second groove realized on the surface 31 of the ring 3. The first groove and the second groove are parallel and accommodate the whole cross section of the spring 35 and 36. Thus, the springs 35 and 36 are flush with the surface 31 of the ring 3. It worth saying that the first helical spring 35 is a unique spring that surround the portions composing the ring 3, as the second helical spring 36 that, in turn, surround the portions composing the ring 3.

The resilient means thus impress a radial force to the ring 3 toward the axis 50. In FIG. 6, the ring 3 is in a mounting position, namely his cross section is completely contained in the groove 6. In this mounting position, the two helical springs 35 and 36 are in a first normal position, impressing a certain radial force to the ring 3 toward the axis 50. In the passage from the first mounting position to the second mounted position, the operator by mean of the screw 10 impose a radial force to the ring 3 (directed according to the sense of the arrow R, as shown in FIGS. 4 and 5) higher and contrary to the force imposed by the two helical springs 35 and 36. The screw 10 engages with the threaded hole on the ring 3, and keep the same on the mounted position.

In the mounted position the ring 3 is raised as shown in FIG. 5. The helical springs 35 and 36 are integral with the ring 3. Thus, in the mounted position the helical springs 35 and 36 are in a second expanded position.

In case of maintenance of the barrel 5, is necessary dismount the cover 2 and extract it from the containment volume in which is inserted. According to one embodiment, the operator thread the screw in the proper sense. Thus the screw 10 disengage the ring 3. The helical spring 35 and 36, in the expanded position, tend to return in their normal position exercising a radial force on the surface 31 of the ring 3 directed to the central axis 50. The force brings back the ring 3 on the groove 6, in the third demounting position. Thus, according to these embodiments, mustn't provided second different means other than screw 10 to bring the ring 3 in a demounting position to carry out maintenance operations.

Embodiments are also directed to a method for fixing a bundle 5 of a turbo machine 100 inside a barrel casing 1 of the machine, wherein before the insertion of the bundle 5 into the barrel casing 1, the split ring 3 is completely inserted within the first groove 6 machined in the external surface of the cover 2. In one embodiment, after the insertion of the bundle 5 into the barrel casing 1, the portions forming the split shear ring 3 are pull up using the screw 10 inserted into the wall of the barrel casing 1 so that, seen in cross section, the segments forming the split shear ring 3 remain engaged partly the first groove 6 and partly the second groove 4.

System for holding a cover 2 connected to a bundle 5 in a barrel casing 1 of a turbo machine 100 by means of a shear ring 3 that engage partly the first groove 6 and partly the second groove 4, the first groove 6 machined in the external cylindrical surface of the cover 2 and the second groove 4 machined in the inner surface of the barrel casing 1 wherein the first groove 6 is adapted to accommodate completely the cross section of the shear ring 3 and wherein the shear ring 3 is maneuverable from outside the barrel casing 1, by mean of screwing means 10.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbo machine comprising:

a barrel casing having a cylindrical internal surface defining an internal containment volume;

a bundle having a cylindrical shape adapted to be accommodated into the internal containment volume;

a cylindrical cover connected to the bundle to close the internal containment volume and hold the bundle inside the barrel casing; and a split shear ring adapted to fix the barrel casing with the cylindrical cover, wherein an external surface of the cylindrical cover is provided with a first circumferential groove and the cylindrical internal surface of the barrel casing is provided with a second circumferential groove, the first circumferential groove and the second circumferential groove adapted to accommodate the cross section of the split shear ring, and wherein the split shear ring is movable from a first position in which the cross section of the split shear ring is completely accommodated into the first circumferential groove to a second position in which the cross section of the split shear ring is partly accommodated into the first circumferential groove and partly accommodated into the second circumferential groove, and the split shear ring is provided with a holding means to hold the split shear ring in the first position.

2. The turbo machine according to claim 1, wherein the second circumferential groove is adapted to accommodate part of the cross section of the split shear ring, when the barrel casing and the cylindrical cover are fixed.

3. The turbo machine according to claim 1, wherein the shear ring is movable from the first position to the second position by a screwing means.

4. The turbo machine according to claim 3, wherein the screwing means comprises a screw passing through a through hole on the outer surface of the barrel casing and engaging a threaded hole on the split shear ring.

5. The turbo machine according to claim 1, wherein the holding means comprises a resilience means operative between a first normal condition when the split shear ring is in the first position and a second expanded condition when the split shear ring is in the second position.

6. A cover for an opening of the barrel casing of the turbo machine according to claim 1.

7. The cover according to claim 6, wherein resilient means are provided that hold the split shear ring completely inside the first circumferential groove.

8. The cover according to claim 7, wherein the split shear ring has at least one hole for pulling up the split shear ring from the first circumferential groove against the action of the resilient means.

9. A method comprising:

providing a turbo machine comprising a barrel casing having a cylindrical internal surface defining an internal containment volume, a bundle having a cylindrical shape adapted to be accommodated into the internal containment volume, a cylindrical cover connected to the bundle to close the internal containment volume and hold the bundle inside the barrel casing, and one or more split shear rings adapted to fix the barrel casing with the cylindrical cover, wherein an external surface of the cylindrical cover is provided with one or more first circumferential recesses and the cylindrical internal surface of the barrel casing is provided with one or more second circumferential recesses, the one or more first circumferential recesses and the one or more second circumferential recesses adapted to accommodate the cross section of the one or more split shear rings; and inserting the bundle of the turbo machine inside the barrel casing of the turbo machine, wherein before inserting the bundle into the barrel casing, the one or more split shear rings are completely inserted within the one or more first circumferential recesses in the external surface of the cylindrical cover, and after insertion of the bundle into the barrel casing, the one or more split shear rings are partially inserted within the one or more first circumferential recesses of the cylindrical cover and partially inserted within the one or more second circumferential recesses of the barrel casing.

10. The method according to claim 9, wherein the one or more split shear rings are held within the one or more recesses of the barrel casing by one or more springs.

11. The method according to claim 9, wherein the one or more split shear rings are pulled out of the one or more recesses of the barrel casing by one or more mechanical devices acting on the one or more split shear rings.

12. The method according to claim 9, wherein after inserting the bundle into the barrel casing, the one or more split shear rings are pulled up using a screw inserted into a wall of the barrel casing so that, seen in cross section, the one or more split shear rings remain engaged partly within the one or more first circumferential recesses and partly within the one or more second circumferential recesses.

* * * * *